US010830462B2

(12) United States Patent
Kaneko et al.

(10) Patent No.: US 10,830,462 B2
(45) Date of Patent: Nov. 10, 2020

(54) CLEAN AIR DEVICE

(71) Applicant: Hitachi Industrial Equipment Systems Co., Ltd., Tokyo (JP)

(72) Inventors: Takeshi Kaneko, Tokyo (JP); Hirotoshi Sato, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 194 days.

(21) Appl. No.: 16/067,264

(22) PCT Filed: Dec. 28, 2016

(86) PCT No.: PCT/JP2016/089015

§ 371 (c)(1),
(2) Date: Jun. 29, 2018

(87) PCT Pub. No.: WO2017/126310

PCT Pub. Date: Jul. 27, 2017

(65) Prior Publication Data

US 2019/0017714 A1 Jan. 17, 2019

(30) Foreign Application Priority Data

Jan. 21, 2016 (JP) ..... 2016-009741

(51) Int. Cl.
*F24F 3/16* (2006.01)
*F24F 7/06* (2006.01)
(Continued)

(52) U.S. Cl.
CPC ..... *F24F 3/1607* (2013.01); *B01L 1/00* (2013.01); *B01L 1/025* (2013.01); *B01L 1/04* (2013.01);
(Continued)

(58) Field of Classification Search
CPC .. F24F 3/1607; F24F 3/161; F24F 7/06; F24F 9/00; B01L 1/00; B01L 1/025; B01L 1/04
(Continued)

(56) References Cited

U.S. PATENT DOCUMENTS 2,244,082 A 6/1941 Reyniers
5,711,705 A * 1/1998 Krainiak ..... A61L 2/208 454/57

(Continued)

FOREIGN PATENT DOCUMENTS

JP 62-24984 A 2/1987
JP 5-76781 A 3/1993

(Continued)

OTHER PUBLICATIONS

Japanese-language International Search Report (PCT/ISA/210) issued in PCT Application No. PCT/JP2016/089015 dated Mar. 28, 2017 with English translation (four (4) pages).

(Continued)

*Primary Examiner* — Edelmira Bosques
*Assistant Examiner* — Dana K Tighe
(74) *Attorney, Agent, or Firm* — Crowell & Moring LLP

(57) ABSTRACT

The purpose of the present invention is to reduce the risk of contamination in a clean air device in which a safety cabinet and clean booths are coupled. To achieve this, a clean air device in which a cabinet and clean booths are coupled, is configured such that the cabinet is equipped with: a work space which is formed on the inner side of a front shutter; and a circulation path which is formed from the lower surface, side surfaces, rear surface of the work space, and an outside portion of the cabinet so as to exhaust the air flowing into the work space. Pass boxes connected to the clean booths are provided to a portion of the side surfaces of the work space. Each of the pass boxes is formed by a pass box
(Continued)

coupling inner surface, the outside of which has a space formed by a pass box coupling outer surface. The space communicates with the circulation path. The bottom of the pass box coupling outer surface is provided with a pass box coupling outer surface slit.

7 Claims, 13 Drawing Sheets

(51) Int. Cl.

| | |
|---|---|
| ***B01L 1/00*** | (2006.01) |
| ***B01L 1/04*** | (2006.01) |
| ***F24F 9/00*** | (2006.01) |
| ***B01L 1/02*** | (2006.01) |

(52) U.S. Cl.
CPC ..... *F24F 3/161* (2013.01); *F24F 7/06* (2013.01); *F24F 9/00* (2013.01)

(58) Field of Classification Search
USPC ..... 454/49
See application file for complete search history.

(56) References Cited

U.S. PATENT DOCUMENTS

| | | | |
|---|---|---|---|
| 2009/0061751 | A1 | 3/2009 | Polsky |
| 2014/0290162 | A1 | 10/2014 | Tanimoto |

FOREIGN PATENT DOCUMENTS

| | | | |
|---|---|---|---|
| JP | 6-319521 | A | 11/1994 |
| JP | 2005-229939 | A | 9/2005 |
| JP | 2006-43521 | A | 2/2006 |
| JP | 2010-161931 | A | 7/2010 |
| JP | 2014-198079 | A | 10/2014 |
| WO | WO 90/05549 | A1 | 5/1990 |
| WO | WO 2015/129452 | A1 | 9/2015 |

OTHER PUBLICATIONS

Japanese-language Written Opinion (PCT/ISA/237) issued in PCT Application No. PCT/JP2016/089015 dated Mar. 28, 2017 (five (5) pages).
Extended European Search Report issued in counterpart European Application No. 16886548.3 dated Sep. 10, 2019 (12 pages).

* cited by examiner

FIG. 5A
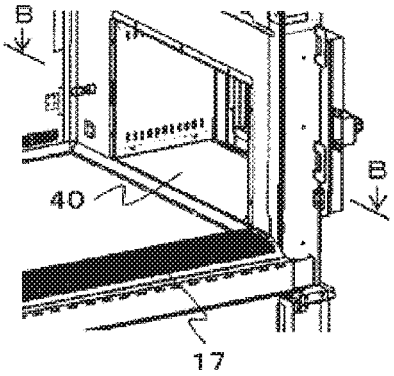
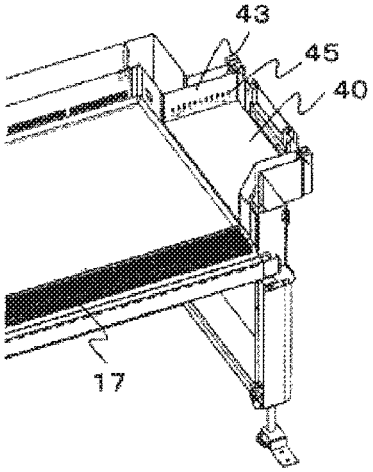
FIG. 5B
FIG. 5C
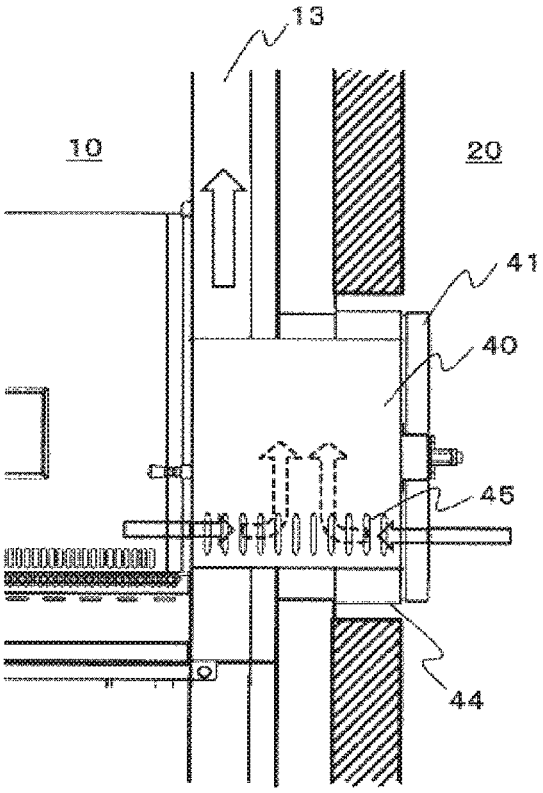

CLEAN AIR DEVICE

TECHNICAL FIELD

The present invention relates to a clean air device which eliminates a contamination risk from outside by air barrier in industrial fields such as medicine and drug manufacturing.

BACKGROUND ART

From related art, clean air devices such as a safety cabinet, a clean bench, and a clean booth have been used as biohazard countermeasures. The clean air device has an isolation capability capable of protecting a sample from outside bacteria, by providing an air barrier and by working in a partitioned space having an opening portion in a part.

On the other hand, regenerative medicine has attracted attention in recent years, and there is an increasing demand for achieving the movement of a series of cell cultivation containers from cell cultivation, medium exchange and packaging within a high cleanliness level corresponding to grade A of air cleanliness, and eliminating the contamination risks.

As a background art in this technical field, there is JP 2006-43521 A (Patent Document 1). Patent Document 1 discloses a plurality of connected safety cabinets, in which circulation flow paths of the connected safety cabinets are connected so as to be the same space, and in the shared circulation flow path, a connecting portion crossing space is constituted in a shape of connecting the work spaces of a plurality of safety cabinets, for the purpose of providing a biohazard safety cabinet which can be delivered to other safety cabinets without extracting experimental materials, which may be infected from the inside of the work space, from the safety cabinet with a simplified connecting structure, and providing a safety cabinet which aims at simplifying the connecting portion structure of the connected type safety cabinet and preventing bacteria and virus due to a pressure control.

CITATION LIST

Patent Document

Patent Document 1 JP 2006-43521 A

SUMMARY OF THE INVENTION

Problems to be Solved by the Invention

In Patent Document 1, work spaces of two safety cabinets are connected to each other to form a connecting portion spanning space at the connecting portion, and the connecting portion spanning space is formed in a common negative pressure contamination plenum, thereby reducing the possibility in which bacteria and virus leaks from the connecting portion spanning space to the outside of the safety cabinet.

However, Patent Document 1 does not consider the contamination between connected safety cabinets, that is, a cross contamination. For example, in the field of regenerative medicine, it is necessary to perform a cell manipulation or a cultivation such as cell cultivation. However, when the cell manipulation is performed in a safety cabinet and the cultivation is performed in a clean booth, it is conceivable to connect the safety cabinet and the clean booth and deliver the cell cultivation container so as to eliminate the contamination risk. In this case, the clean booth has a lower degree of cleanliness than the safety cabinet in order for people to enter and work for working. Therefore, there is a risk in which air on the clean booth side flows in via the connecting portion and contaminates the interior of the safety cabinet.

An object of the present invention is to reduce contamination risk in a clean air device in which a safety cabinet (hereinafter abbreviated as a cabinet) and a clean booth are connected.

Solutions to Problems

In order to solve the above problem, according to the present invention, for example, there is provided a clean air device in which a cabinet and a clean booth are connected, wherein the cabinet includes a work space formed on an inner surface side of a front shutter, and a circulation flow path which is formed by a lower surface side, a side surface side and a rear surface side of the work space and an outside portion of the cabinet to exhaust the air flowing into the work space, a pass box connected to the clean booth is provided in a part of a side wall of the work space, and the pass box is formed by an inner surface of a pass box connection portion, a space formed by an outer surface of the pass box connection portion is included outside the inner surface of the pass box connection portion, the space communicates with the circulation flow path, and an outer surface slit of the pass box connection portion is provided at a lower part of the outer surface of the pass box connection.

Effects of the Invention

According to the present invention, it is possible to reduce the risk of contamination in the clean air device in which the cabinet and the clean booth are connected.

BRIEF DESCRIPTION OF THE DRAWINGS

FIGS. 5A to 5C are structural diagrams of the vicinity of a connecting portion which includes a pass box connecting a cabinet and a clean booth according to a second embodiment, and an image diagram of an air flow.

MODE FOR CARRYING OUT THE INVENTION

Embodiments of the present invention will be described below with reference to the drawings. It should be noted that the present invention is not limited thereto.

First Embodiment

Figure 1A:
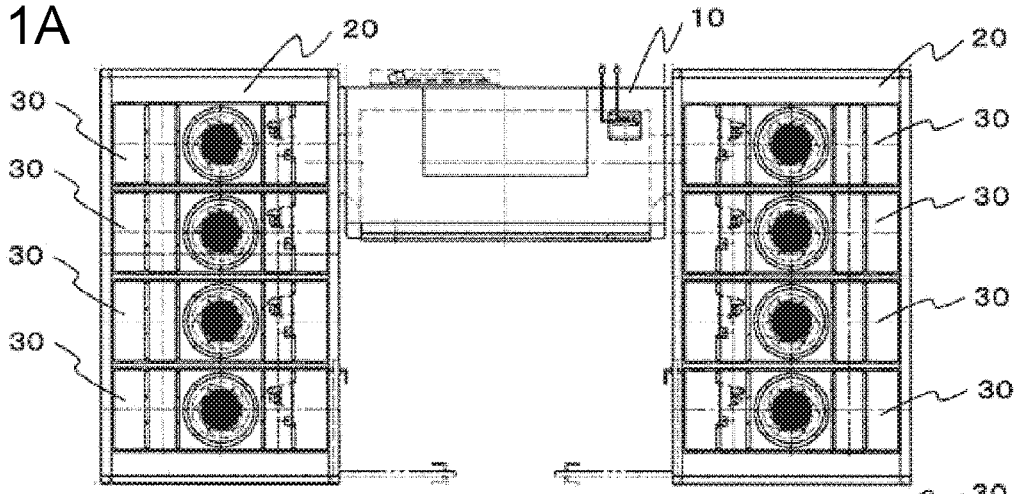
FIGS. 1A and 1B are overall configuration diagrams of a clean air device including a cabinet and a clean booth according to a first embodiment.
Figure 1B:
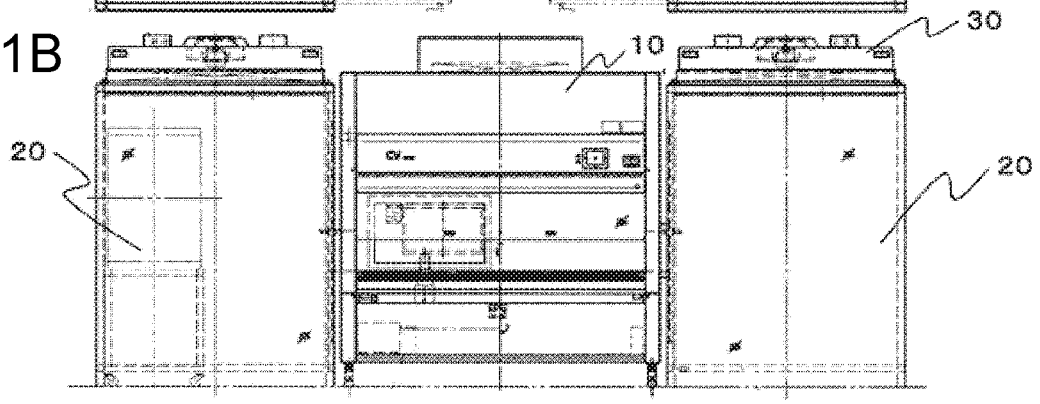

FIG. 1 is an overall configuration diagram of a clean air device including a cabinet and a clean booth in this embodiment. FIG. 1(A) is a plan view, FIG. 1(B) is a front view, and a cabinet 10, a clean booth 20, and a fan filter unit (FFU) 30 are provided. The cabinet 10 is a device which performs a cell manipulation such as cell cultivation by putting only arms of a person. The clean booth 20 is a cultivation or centrifugal material booth, or a receiving base material booth, and is a space in which a person enters and works. Further, the FFU 30 is a unit in which a fan and a filter are incorporated in a casing, and air sucked by the fan is cleaned through the HEPA filter and sent out as a clean air.

Figure 2:
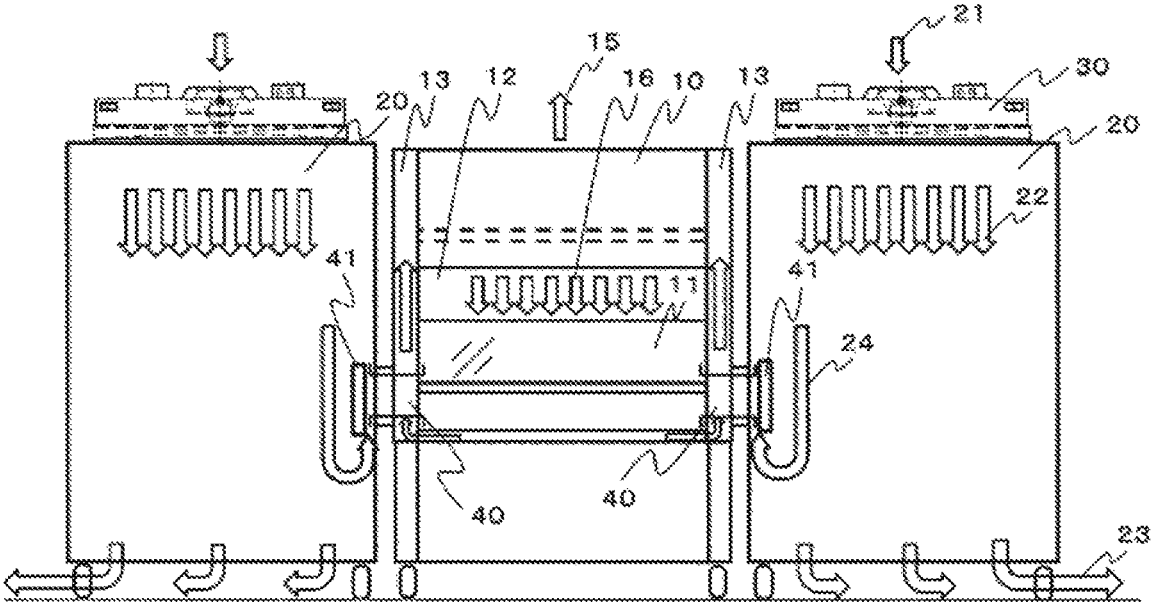
FIG. 2 is an image diagram of an air flow of the clean air device including the cabinet and the clean booth according to the first embodiment.
Figure 3D:
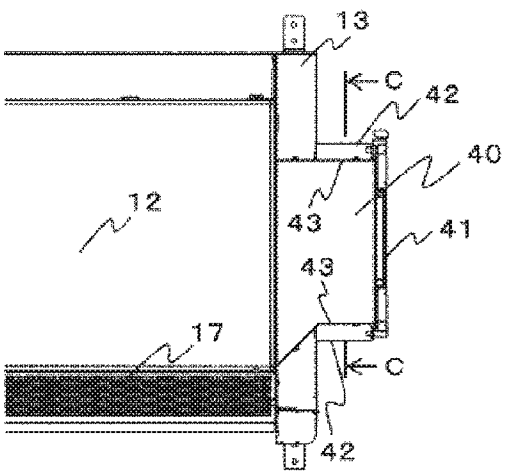
FIGS. 3A to 3E are structural diagrams of the vicinity of a connecting portion which includes a pass box connecting the cabinet and the clean booth according to the first embodiment.
Figure 3E:
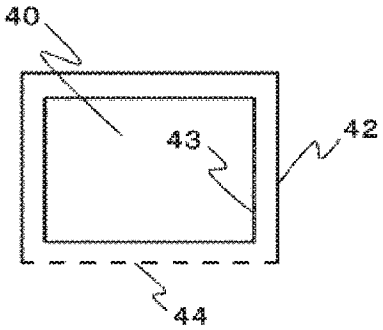
Figure 3B:
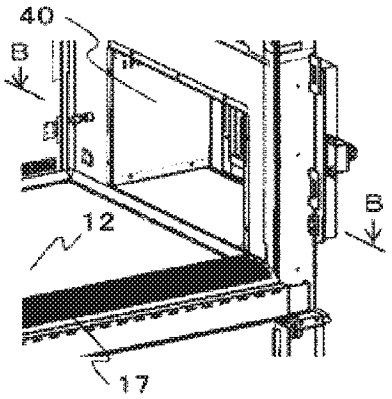
Figure 3C:
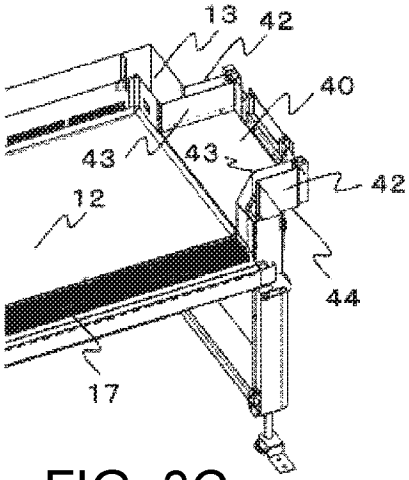
Figure 3A:
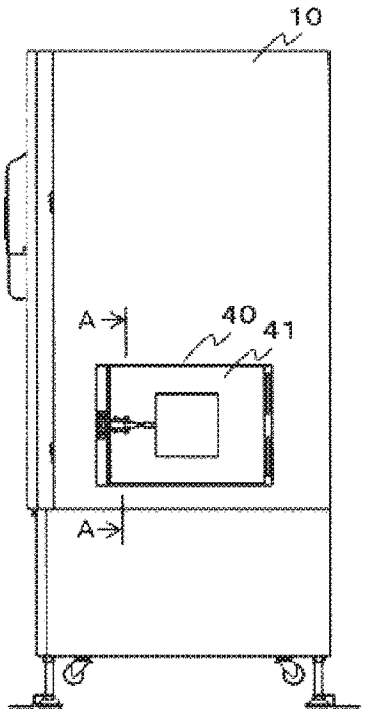

FIG. 2 is an image diagram of the air flow of the clean air device including the cabinet and the clean booth in this embodiment. In FIG. 2, the cabinet 10 includes a front shutter 11, a work space 12 which is formed on an inner surface side of the front shutter 11 and holds a negative pressure state, and a circulation flow path 13 which is formed from a lower surface side, a side surface side and a rear surface side of the work space 12 and an outer side portion of a main body of the cabinet 10 to exhaust the air flowing into the work space 12. A worker inserts an arm from a front opening portion of the cabinet 10, looks into the work space 12 from the front shutter 11, and performs a cell manipulation work in the work space 12.

Further, the cabinet 10 and the clean booth 20 are connected by a pass box 40. In the pass box 40, a connecting opening is provided in a part of a side surface wall of the work space 12, and has a structure which is capable of delivering a material which may be infected from the work space 12 of the cabinet 10 to the clean booth 20, without extracting the material from the cabinet. A pass box 40 has a pass box door 41, and is capable of shutting off the flow path with the clean booth 20 by closing the pass box door 41.

In FIG. 2, the flow of the air flow will be described. In the cabinet 10, the air sucked from the front opening portion passes through the circulation flow path 13 at the lower part, the rear surface, and the side surface of the work space 12, and is sucked into a blower (not illustrated). A part of the air sucked into the blower is filtered by an air supply HEPA filter (not illustrated), the other part of the air is filtered by an exhaust HEPA filter (not illustrated) as clean air in the work space 12, and thus, the air is discharged as clean air to the outside of the cabinet 10 as the cabinet exhaust air flow 15. The cabinet blow-off air flow 16 supplied into the work space 12 cleans the interior of the work space 12, a part thereof is sucked from a front grill 17 which will be described later, the other part thereof is sucked from the cabinet rear slit 14 which will be described later, and thus, the cabinet blow-off air flow 16 is sucked into the blower through the circulation flow path 13. By the air purification using the HEPA filter and the control of the air flow of the front opening portion or the like, the material which may be infected is isolated from the external environment or workers to prevent infection.

Further, in the clean booth 20, the clean booth inflow air flow 21 is filtered by the HEPA filter through the FFU 30, flows in as clean air into the clean booth 20 as a clean booth blow-off air flow 22, and is discharged as a clean booth exhaust air flow 23 from the clean booth 20. On the other hand, a part of the clean booth blow-off air flow 22 forms a flow path which is discharged to the outside of the cabinet 10 through the circulation flow path 13 of the cabinet 10 from an outer surface slit 44 of the pass box connection portion to be described later, and functions as a clean booth air barrier 24.

Hereinafter, functions of the outer surface slit 44 of the pass box connection portion and the clean booth air barrier 24 will be described.

FIG. 3 is a structural view of the periphery of the connecting portion including the pass box 40 which connects the cabinet 10 and the clean booth 20 in this embodiment. FIG. 3(A) is an external view of the cabinet 10 as viewed from the side surface on which the pass box 40 is installed. FIG. 3(B) is a perspective view of the pass box 40 as viewed from the work space 12 of the cabinet 10. FIG. 3(C) is a cross-sectional perspective view at a position B-B illustrated in FIG. 3(B). FIG. 3(D) is a cross-sectional plan view at the position B-B illustrated in FIG. 3(B). FIG. 3(E) is a cross-sectional view at a position C-C illustrated in FIG. 3(D). In FIGS. 3(C) and 3(D), the pass box 40 is formed by an inner surface 43 of the pass box connection portion, and an outer surface 42 of the pass box connection portion is formed outside the pass box 40 via a space. Further, the space between the inner surface 43 of the pass box connection portion and the outer surface 42 of the pass box connection portion communicates with the circulation flow path 13 of the cabinet 10. Further, as illustrated in FIG. 3(E), the space between the inner surface 43 of the pass box connection portion and the outer surface 42 of the pass box connection portion is configured to communicate with the space on the clean booth side, by providing an outer surface slit 44 of the pass box connection portion at the lower part of the outer surface 42 of the pass box connection portion.

Figure 4:
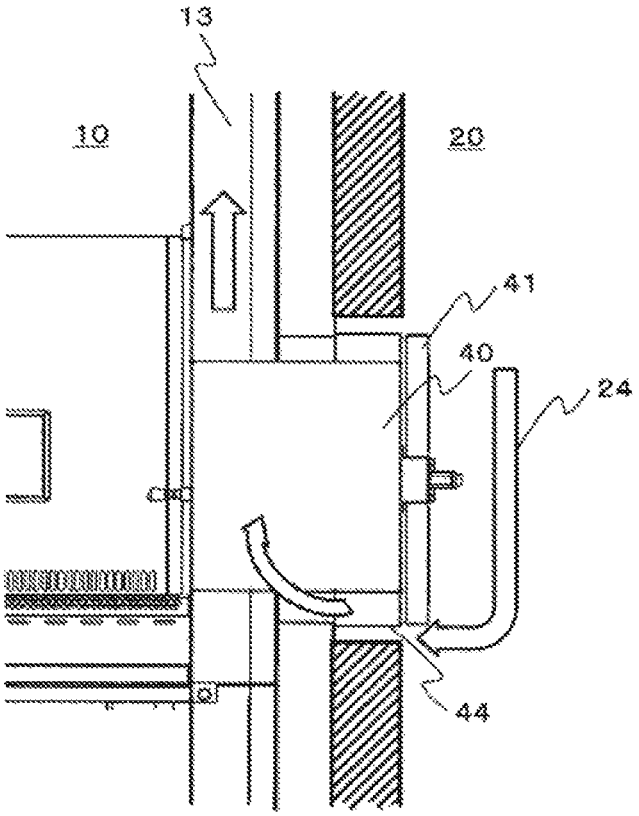
FIG. 4 is an image diagram of the air flow in the vicinity of the connecting portion of the cabinet and the clean booth in the first embodiment.

FIG. 4 illustrates an image diagram of the air flow around the connecting portion between the cabinet 10 and the clean booth 20 in this embodiment. FIG. 4 a cross-sectional view of the periphery of the pass box 40, which is a connecting portion, at a position A-A illustrated in FIG. 3(A). In FIG. 4, a part of the clean booth blow-off air flow 22 described in FIG. 2 forms a flow path discharged to the outside of the cabinet 10 from the aforementioned outer surface slit 44 of the pass box connection portion through the circulation flow path 13 of the cabinet 10, and functions as a clean booth air barrier 24.

Thus, even when the pass box door 41 is closed or opened, it is possible to suppress the risk in which the air on the clean booth 20 side enters the pass box 40. Alternatively, even when the pass box door is not attached, it is possible to suppress the risk of air on the clean booth side entering the pass box.

As described above, this embodiment is a clean air device in which a cabinet and a clean booth are connected, and the cabinet has a work space formed on an inner surface side of a front shutter, and a circulation flow path which is formed by a lower surface side, a side surface side and a rear surface side of the work space and an outside portion of the cabinet to exhaust the air flowing into the work space, a pass box connected to the clean booth is provided in a part of the side wall of the work space, the pass box is formed by an inner surface of the pass box connection portion, a space formed by the outer surface of the pass box connection portion is included outside the inner surface of the pass box connection portion, the space communicates with the circulation flow path, and an outer surface slit of the pass box connection portion is provided at the lower part of the outer surface of the pass box connection.

As a result, the risk of contamination can be reduced in the clean air device in which the cabinet and the clean booth are connected.

Second Embodiment

This embodiment will describe an example in which the risk of contamination is further reduced in a clean air device in which a cabinet and a clean booth are connected.

FIG. 5 is a structural view in the vicinity of the connecting portion including the pass box 40 which connects the cabinet 10 and the clean booth 20 in this embodiment, and an image diagram of the air flow. FIG. 5(A) is a perspective view of the pass box 40 viewed from the work space 12 of the cabinet 10, FIG. 5(B) is a cross-sectional perspective view at a position B-B illustrated in FIG. 5(A), and FIG. 5(C) is a longitudinal sectional view of the periphery of the pass box 40 which is the connecting portion as viewed from the front. In FIG. 5, since the parts other than the inner surface slit 45 of the pass box connection portion are the same as those of FIGS. 3 and 4 of the first embodiment, the description thereof will be not be provided.

In FIG. 5, the inner surface slit 45 of the pass box connection portion is provided on the inner surface 43 of the pass box connection portion. As illustrated in FIG. 5(C), when the pass box door 41 is closed, a flow of air is generated in which the air on the side of the cabinet 10 is sucked to the side of the pass box 40, and the sucked air is discharged from the inner surface slit 45 of the pass box connection portion via the circulation flow path 13 of the cabinet 10. This makes it possible to suppress mutual contamination of the clean booth 20 and the cabinet 10.

Similarly, even when the pass box door 41 is opened, a flow of air is generated in which the air sucked from the clean booth 20 side is discharged from the inner surface slit 45 of the pass box connection portion via the circulation flow path 13 of the cabinet 10. This makes it possible to prevent an inflow of air into the cabinet 10 side and to suppress the mutual contamination of the clean booth 20 and the cabinet 10. The inner surface slit 45 of the pass box connection portion may be provided at any position on the inner surface 43 of the pass box connection portion, and may be provided, for example, on a rear surface side surface or an upper surface.

Figure 6A:
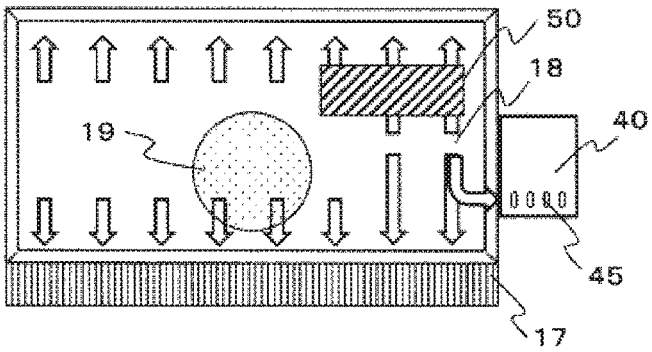
FIGS. 6A and 6B are plan views of a work space of the cabinet in the second embodiment.
Figure 6B:
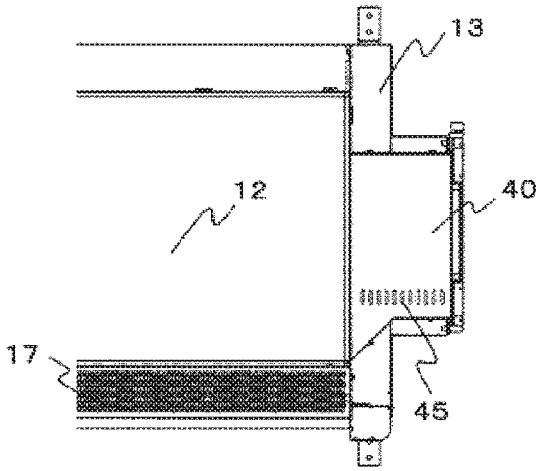

Further, by providing the inner surface slit 45 of the pass box connection portion on the front bottom surface or the front side surface of the inner surface 43 of the pass box connection portion, it is easy to control an air flow branching point 18 to be described later to the front side in the work space 12. FIG. 6 is a plan view of the work space 12 of the cabinet 10. FIG. 6(A) is a schematic view, and FIG. 6(B) is a cross-sectional plan view of the periphery of the connecting portion which includes the pass box 40 connecting the cabinet 10 and the clean booth 20. In FIG. 6, a case where the inner surface slit 45 of the pass box connection portion is disposed on the front bottom surface of the inner surface of the pass box connection portion is illustrated. As illustrated in FIG. 6(A), a part of the cabinet blow-off air flow 16 supplied into the aforementioned work space 12 is sucked from the front grill 17, the other part thereof is sucked from a cabinet rear slit 14 which will be described later, and thus, the cabinet blow-off air flow 16 is discharged through the flow path 13. Here, the air flow branching point 18 branching to the front grill 17 and the cabinet rear slit 14 is able to control the air flow branching point to the front side in the work space 12, by setting the inner surface slit 45 of the pass box connection portion to the front side in the work space 12.

This makes it possible to prevent the contaminants attached to a waste can 50 from coming forward and to prevent contamination of the sample on the work table 19 due to the installation of the waste can 50.

Third Embodiment

This embodiment will describe an example in which an air-tight cover is attached to the outer surface of the cabinet to form an air flow equivalent to the time of connection of a clean booth, in the case of not connecting the clean booth in the clean air device in which the cabinet and the clean booth are connected.

Figure 7:
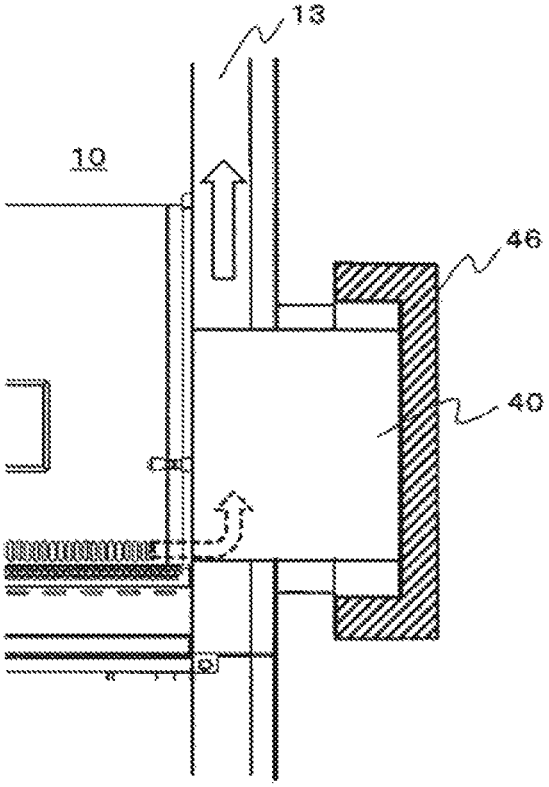
FIG. 7 is a longitudinal sectional view as seen from the front of the periphery of a pass box as a connecting portion of a cabinet and a clean booth in a third embodiment.

FIG. 7 is a longitudinal sectional view of the periphery of the pass box 40, which is the connecting portion of the cabinet and the clean booth in this embodiment, as viewed from the front surface. In FIG. 7, when the clean booth is not connected to the cabinet 10, an air-tight cover 46 is attached to the outer surface of the pass box 40 to form an air flow equivalent to the time of connection of a clean booth. As a result, even when the clean booth is connected or not connected, a part of the cabinet blow-off air flow 16 supplied into the work space 12 of the cabinet 10 is sucked from the front grill 17, the other part thereof is sucked from the cabinet rear slit 14, and thus, the cabinet blow-off air flow is discharged through the circulation flow path 13. Therefore, since the air flow of the cabinet 10 forms the same flow, the same performance can be maintained regardless of whether the cabinet 10 is a single unit or a clean booth is connected to the cabinet 10.

Further, it is also possible to install a cabinet first and use a clean booth later.

Moreover, in the cabinet, it is necessary to separately evaluate the physical isolation performance using Bacillus subtilis spores if the state of the air flow changes in JIS-K 3800. However, in this case, there is an advantage that because the air flow state does not change, new air flow adjustment becomes unnecessary and there is also no need for a new evaluation.

Fourth Embodiment

This embodiment will describe an example in which the risk of contamination is further reduced when the door of the pass box connection portion is opened, in a clean air device in which a cabinet and a clean booth are connected by a pass box.

Figure 8:
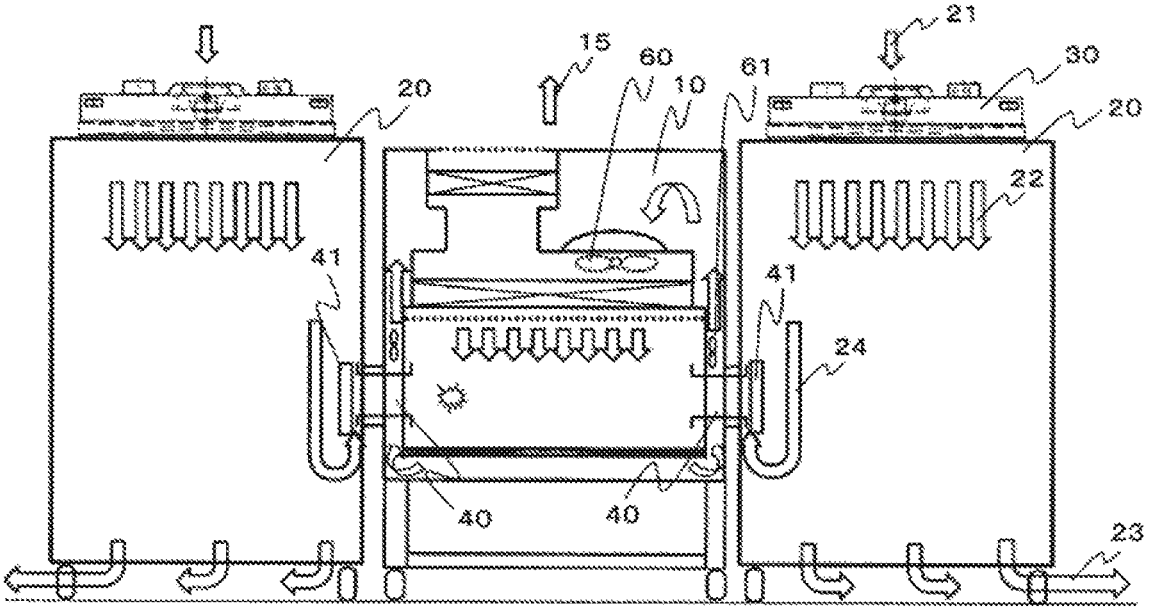
FIG. 8 is a structural view of a clean air device in which a cabinet and a clean booth are connected according to a fourth embodiment, and an image diagram of an air flow.

FIG. 8 is a structural view of the clean air device in which the cabinet 10 and the clean booth 20 are connected, and an image diagram of the air flow in this embodiment. In FIG. 8, since the parts except for a cabinet fan 60 and a fan 61 are the same as those of FIG. 2 of the first embodiment, the description thereof will not be provided. In FIG. 8, a door switch for detecting the opening and closing of a door (not illustrated) is provided in the pass box door 41 of the pass box 40, and when the pass box door 41 is opened, the door switch is turned ON and the capability of the cabinet fan 60 of the cabinet 10 rises, or the operation of the fan 61 installed separately is started. That is, the cabinet fan 60 is controlled by an inverter, and when the pass box door 41 is opened, the processing air volume is increased by raising the inverter frequency. Further, the separately installed fan 61 is operated to locally exhaust air when the pass box door 41 is opened.

Thus, when the pass box door is opened, it is possible to suppress the risk of entry of air on the clean booth side into the pass box by controlling the processing air volume of the fan. In addition, even when the pass box door is not attached, it is possible to suppress the risk of entry of air on the clean booth side into the pass box.

Fifth Embodiment

This embodiment will describe an example in which the exhaust of the clean booth is returned to a part of the exhaust path of the cabinet and circulates in a clean air device in which a cabinet and a clean booth are connected by a pass box.

Figure 9:
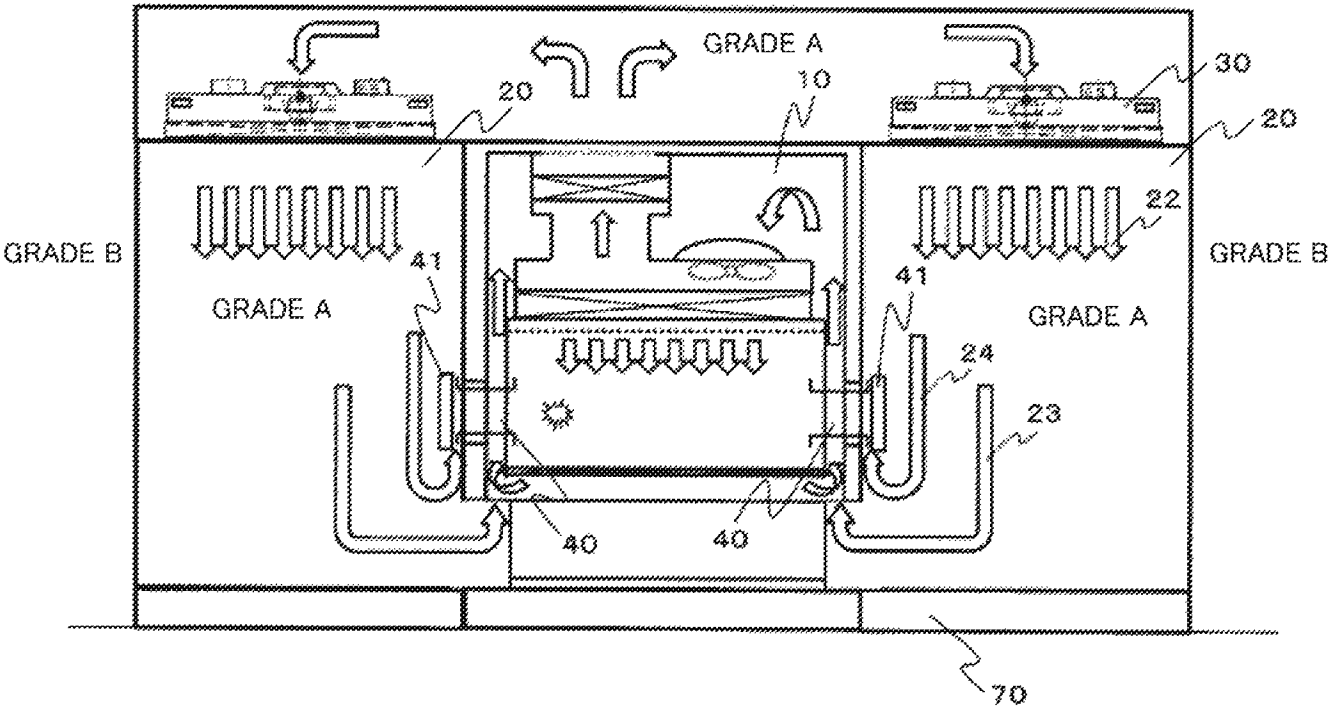
FIG. 9 is a structural diagram of a clean air device in which a cabinet and a clean booth are connected in a fifth embodiment, and an image diagram of an air flow.

FIG. 9 is a structural view of a clean air device in which the cabinet 10 and the clean booth 20 are connected in this embodiment, and an image diagram of the air flow. In FIG. 9, since the parts except for the clean booth exhaust air flow 23 and the leg exhaust port closing mechanism 70 are the same as those of FIG. 2 of the first embodiment, the description thereof will not be provided. In FIG. 9, the clean booth blow-off air flow 22 in the clean booth 20 is configured to return to a part of the exhaust path of the cabinet 10 as the clean booth exhaust air flow 23 and circulate. That is, the clean air device has a leg exhaust port closing mechanism 70 that closes the leg exhaust port of the clean booth 20, and the air flow is configured to return to a part of the exhaust path of the cabinet 10 and circulate.

This makes it possible to construct a space in which the cabinet and the clean booth are integrated. Further, since the cabinet and the clean booth have a cleanliness level of air as one space of grade A, the risk of contamination sample can be dramatically suppressed. Also, by providing the integral system, since the air flow is stabilized even if the system is installed in any space where the cleanliness level of air is grade B, contamination due to soaring of the air flow can be prevented. Also, since the exhaust from the clean booth or the cabinet is not discharged to the work space of the grade B, it is possible to suppress the turbulence of the space of the grade B. Alternatively, the clean room itself called grade B becomes unnecessary, and the construction cost can be greatly reduced.

Sixth Embodiment

This embodiment will describe an example in which the risk of contamination is further reduced in the clean air device, particularly in the cabinet.

Figure 10A:
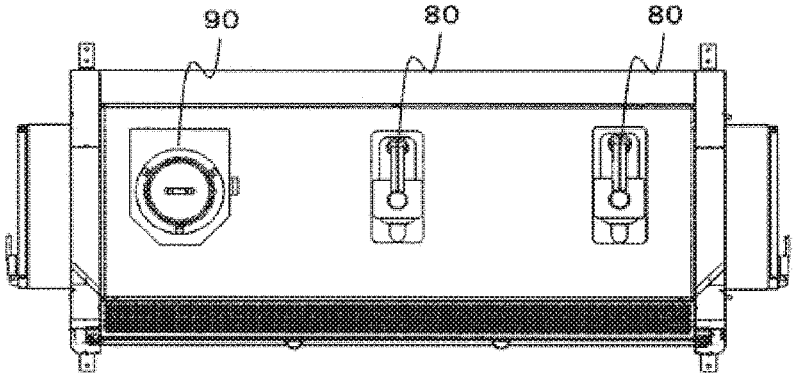
FIGS. 10A and 10B are a cross-sectional plan view and a cross-sectional perspective view of a work space of a cabinet in a sixth embodiment.
Figure 10B:
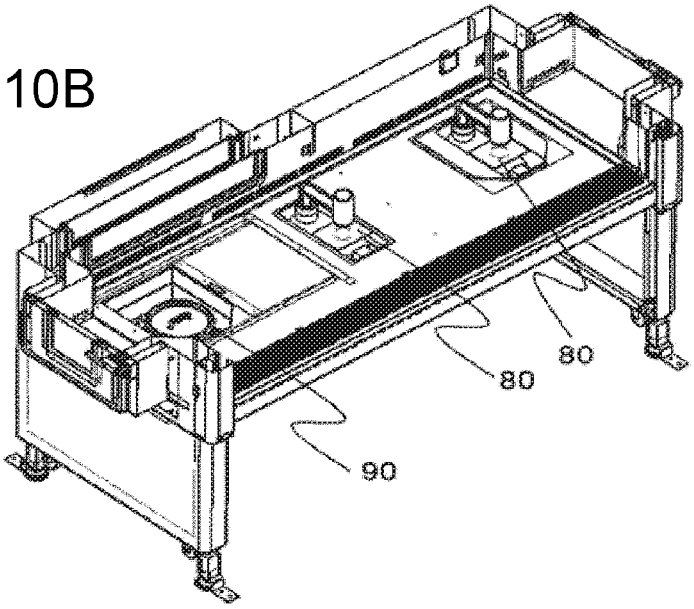

FIG. 10 is a cross-sectional view of the work space 12 of the cabinet 10 in this embodiment. FIG. 10(A) is a cross-sectional plan view and FIG. 10(B) is a cross-sectional perspective view. In FIG. 10, a microscope 80 observes cells and the like, and a dust chute (waste can) 90 is provided. In a storage portion penetrating the circulation flow path at the bottom of the work space 12 is detachably attached at the opening portion of the bottom surface of the work space 12.

Figure 11:
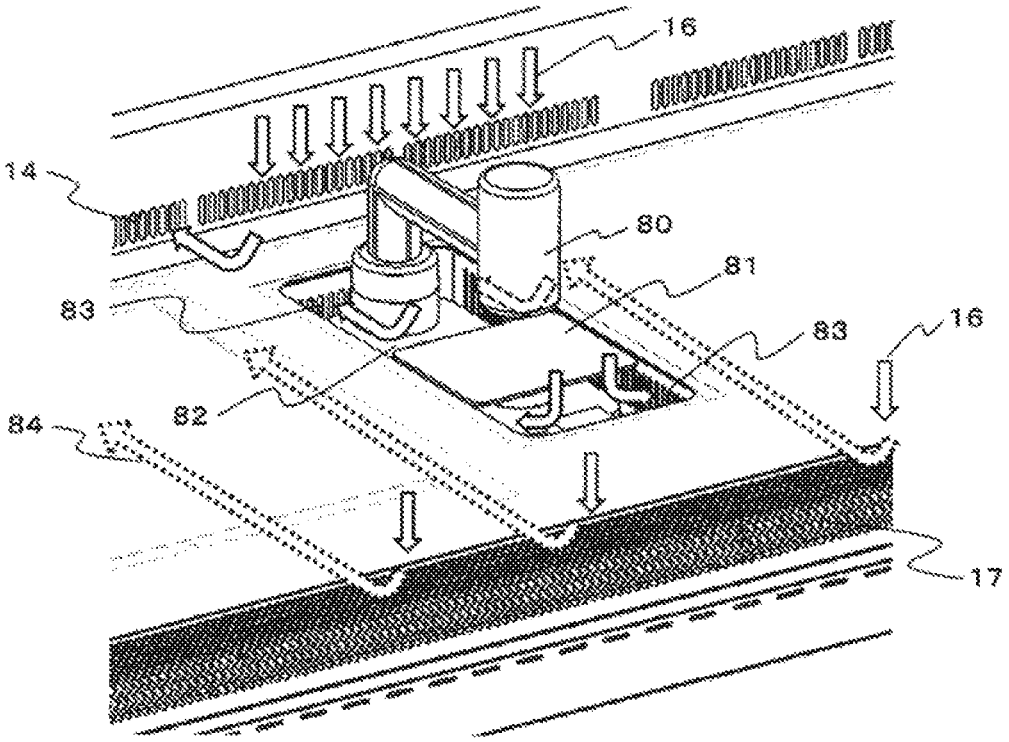
FIG. 11 is a detailed configuration diagram of a storage portion that stores a microscope in the sixth embodiment.

FIG. 11 is a detailed configuration diagram of a storage portion that stores the microscope 80 in this embodiment. In FIG. 11, the microscope stage 81 observes a sample of a microscope, and a microscope storage portion 82 is provided. A part of the cabinet blow-off air flow 16 supplied into the work space 12 of the cabinet 10 passes through a work space lower circulation flow path 84 from the front grill 17 and is discharged through the circulation flow path 13 on the rear surface, and the other part thereof is sucked from the cabinet rear slit 14 and discharged through the circulation flow path 13. The microscope storage portion 82 is installed to penetrate the work space lower circulation flow path 84. Further, the microscope storage portion 82 is provided with a microscope storage portion slit 83 on the side surface of the storage portion. As a result, it is possible to suppress the scattering of the sample by making the periphery of the microscope storage portion 82 negative pressure and by increasing the wind speed.

In addition to the slit, the microscope storage portion slit 83 may be an exhaust opening portion such as a punching hole. Also, in FIG. 11, the storage portion for the microscope has been described, but the storage portion is not limited to the microscope and may be a storage portion for a dust chute, or the like.

Therefore, according to this embodiment, it is possible to collect contaminants placed on a detachably attached container or a sample observed with a microscope to the HEPA filter side of the cabinet without scattering, thereby preventing contamination.

Seventh Embodiment

This embodiment will describe an example in which the risk of contamination is further reduced in a clean air device, particularly in a cabinet.

Figure 12A:
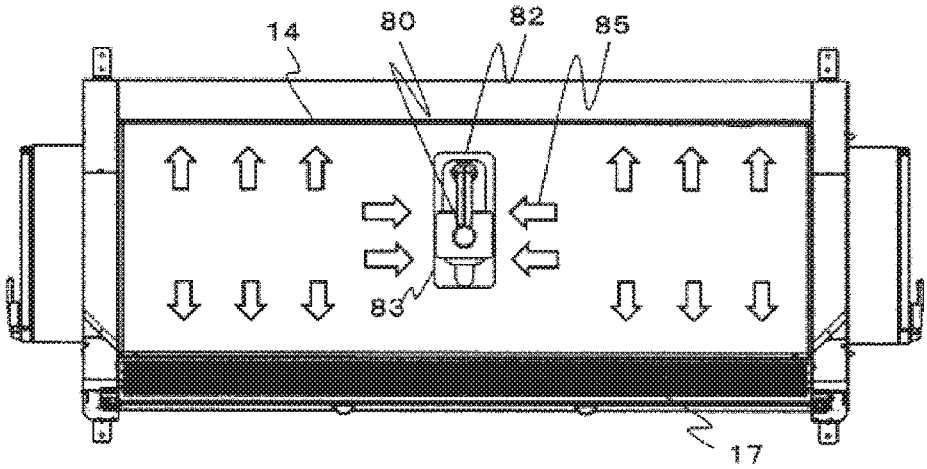
FIGS. 12A and 12B are a cross-sectional plan view and a cross-sectional perspective view of a work space of a cabinet for describing a seventh embodiment.
Figure 12B:
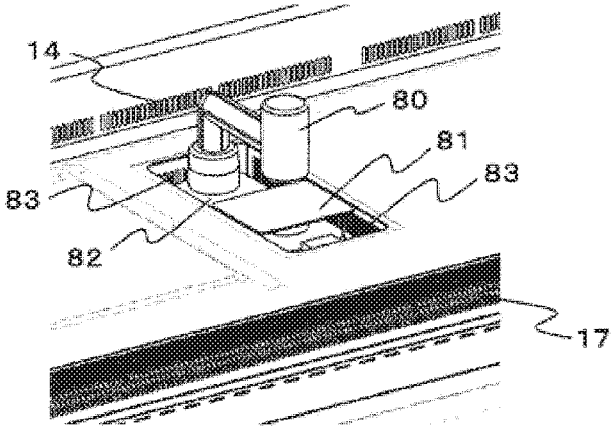

FIG. 12 is a cross-sectional plan view and a cross-sectional perspective view of a work space of the cabinet for describing this embodiment. FIG. 12(A) is a cross-sectional plan view, and FIG. 12(B) is a cross-sectional perspective view, and FIGS. 12(A) and 12(B) illustrate a case where the microscope storage portion 82 illustrated in the sixth embodiment is disposed. In FIG. 12, since the microscope storage portion 82 has the microscope storage portion slit 83, there is a problem of a possibility that the contaminated air around the microscope storage portion 82 gathers on the side of the microscope 80 due to the storage portion suction air flow 85 as illustrated in the drawing and the sample observed with a microscope may be contaminated.

Figure 13A:
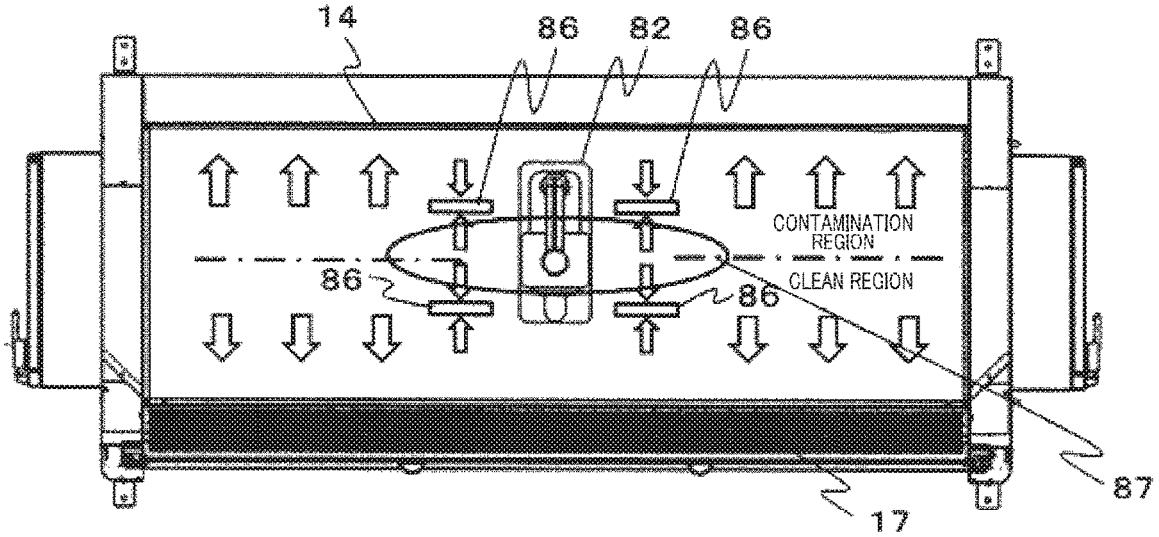
FIGS. 13A and 13B are a cross-sectional plan view and a cross-sectional perspective view of a work space of a cabinet in the seventh embodiment.
Figure 13B:
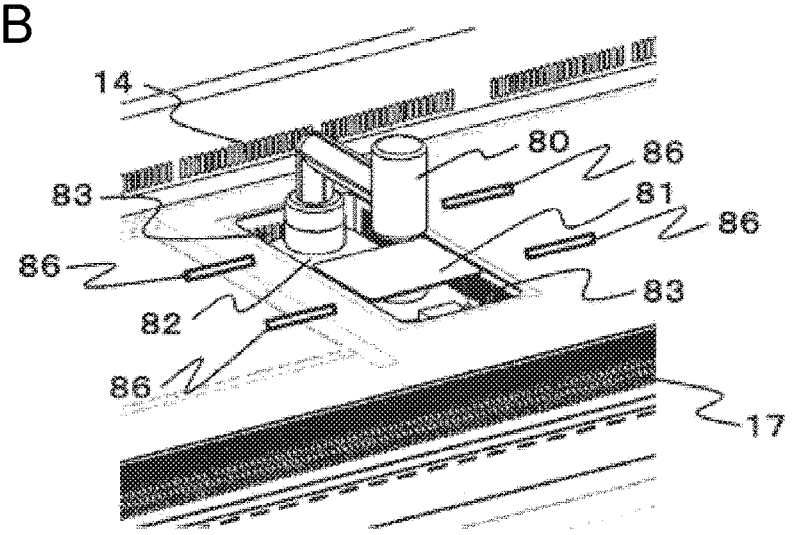

FIG. 13 is a cross-sectional plan view and a cross-sectional perspective view of the work space of the cabinet in this embodiment. FIG. 13(A) is a cross-sectional plan view and FIG. 13(B) is a cross-sectional perspective view, and the difference from FIG. 12 is that a work space bottom slit 86 is provided.

Here, a part of the cabinet blow-off air flow 16 supplied into the work space 12 is sucked from the front grill 17, the other part thereof is sucked from the cabinet rear slit 14, and the cabinet blow-off air flow 16 is discharged through the circulation flow path 13. Therefore, the rear surface side of the air flow branching point illustrated by the one-dotted chain line branching to the front grill 17 and the cabinet rear slit 14 is a contaminated region and the front side is a clean side. Here, the work space bottom slit 86, which is a lateral slit or a punching hole, is provided in the central part of the work space to divide the air flow branching point. Therefore, for example, this range in which there is a possibility of opening the lid of the dish containing the cells to be observed with the microscope can be held in the local clean space 87, and the possibility of contamination can be suppressed.

In FIGS. 12 and 13, the microscope storage portion has been described, but it is not limited to the microscope, but may be a storage portion for a dust chute or the like.

Although the embodiments have been described above, the present invention is not limited to the embodiments described above, but includes various modified examples. For example, the above-described embodiments have been described in detail in order to describe the present invention in an easy-to-understand manner, and are not necessarily limited to those having all the configurations described. Further, a part of the configuration of one embodiment can be replaced by the configuration of another embodiment, and the configuration of another embodiment can also be added to the configuration of one embodiment. In addition, it is possible to add, delete, and replace other configurations with respect to part of the configuration of each embodiment.

REFERENCE SIGNS LIST

10 cabinet
11 front shutter
12 work space
13 circulation flow path
14 cabinet rear slit
15 cabinet exhaust air flow
16 cabinet blow-off air flow
17 front grill
18 air flow branching point
19 work table
20 clean booth
21 clean booth inflow air flow
22 clean booth blow-off air flow
23 clean booth exhaust air flow
24 clean booth air barrier
30 FFU
40 pass box
41 pass box door
42 outer surface of pass box connection portion
43 inner surface of pass box connection portion
44 outer surface slit of pass box connection portion
45 inner surface slit of pass box connection portion
46 air-tight cover
50 waste can
60 cabinet fan
61 fan
70 leg exhaust closing mechanism
80 microscope
81 microscope stage
82 microscope storage portion
83 microscope storage portion slit
84 work space lower circulation flow path
85 storage portion suction air flow
86 work space bottom slit
87 local clean space
90 dust chute (waste can)

The invention claimed is:

1. A clean air apparatus comprising:

a clear air device in which a cabinet and a clean booth are connected, wherein the cabinet includes a work space formed on an inner surface side of a front shutter, and a pass box connected to the clean booth which is provided in a part of a side wall of the work space, a circulation flow path which is formed by a lower surface side, a side surface side and a rear surface side of the work space and an outside portion of the cabinet to exhaust the air flowing into the work space, the pass box is formed by an inner surface of a pass box connection portion, an outer surface of the pass box connection portion is formed outside the pass box via a space and the space is formed between the inner surface of the pass box connection portion and the outer surface of the pass box connection portion, the space communicates with the circulation flow path, and an outer surface slit of the pass box connection portion is provided at a lower part of the outer surface of the pass box connection portion.

2. The clean air apparatus according to claim 1, wherein an inner surface slit of the pass box connection portion is provided in a part of the inner surface of the pass box connection portion.

3. The clean air apparatus according to claim 2, wherein the inner surface slit of the pass box connection portion is provided on the inner surface of the pass box connection portion on a front bottom side or a front side surface of the pass box.

4. The clean air apparatus according to claim 1, wherein when the clean booth is not connected to the cabinet, an air-tight cover is attached to an outer surface of the pass box.

5. The clean air apparatus according to claim 1, wherein a door and a door switch which detects opening and closing of the door are provided in the pass box, and when the door is opened, the door switch is turned ON to increase the a capability of the fan provided in the cabinet, or an operation of a separately installed fan is started.

6. The clean air apparatus according to claim 1, wherein a storage portion is configured to penetrate a circulation flow path on a lower side of the work space is included at an opening portion on a bottom surface of the work space, and the storage portion is provided with a slit on a side surface.

7. The clean air apparatus according to claim 6, wherein a work space bottom slit which is a lateral slit or a punching hole is provided in a central part of the work space to divide an air flow branching point which branches to a lower front surface and a lower rear surface of the air flow passing through the circulation flow path from the lower side of the work space.

* * * * *